United States Patent [19]

Tanaka

[11] 4,095,405

[45] Jun. 20, 1978

[54] ELECTRONIC WATCH

[75] Inventor: Kojiro Tanaka, Tokyo, Japan

[73] Assignee: Kabushiki Kaisha Daini Seikosha, Japan

[21] Appl. No.: 725,713

[22] Filed: Sep. 23, 1976

[30] Foreign Application Priority Data

Sep. 23, 1975 Japan ..... 50-115209

[51] Int. Cl.[2] ..... G04B 19/24; G04B 19/34; G04B 27/08; G04C 3/00

[52] U.S. Cl. ..... 58/4 A; 58/23 R; 58/23 A; 58/50 R; 58/58; 58/85.5; 58/88 B; 58/127 R

[58] Field of Search ..... 58/4 A, 23 R, 23 A, 58/50 R, 58, 88 B, 126 R, 126 D, 127 R, 128, 85.5

[56] References Cited

U.S. PATENT DOCUMENTS 3,844,105 10/1974 Kashio ..... 58/23 R 3,959,963 6/1976 Murrell ..... 58/50 R 3,978,296 8/1976 Moriya et al. ..... 58/4 A X

*Primary Examiner*—Stanley J. Witkowski

*Attorney, Agent, or Firm*—Robert E. Burns; Emmanuel J. Lobato; Bruce L. Adams

[57] ABSTRACT

An all electronic watch has an analog minute and hour display comprising two concentric circles of radially disposed LEDs which are energized sequentially in a manner to simulate the movement of the minute and hour hands of a mechanical watch, and a centrally located digital display of date. The circuitry for energizing the LEDs of the analog minute and hour display and the digital date display comprise up-down counters. Amendment of time in a forward direction or in a backward direction is effected by switches actuated by the crown of the watch to feed fast pulses to the counters to operate the counters in a forward direction or in a backward direction as desired. The crown has two operational positions and is rotatable selectively in opposite directions in the manner of a mechanical watch to effect time and date amendment forwardly or backwardly.

5 Claims, 9 Drawing Figures

ELECTRONIC WATCH

BACKGROUND OF THE INVENTION

This invention concerns an electronic watch which provides an analogical time display with an analog display unit comprised of a plurality of display segments and also carries out time modification by operating a crown thereof.

There are two types of time displays of traditional electronic watches, one of which is a hand-pointer type having an electro-mechanical converter such as a step motor and the other is a digital type using digital display elements.

The hand pointer type electronic watch has the following defects. It is difficult to produce high precision watches because of error in the actions due to use of mechanical elements and also it is questionable from the stand point of reliability and production cost, and moreover it is difficult to read time in a dark place such as at night time.

Against the above type, with the digital display type time can be read even in a dark place according to use of display elements such as light emitting diodes (LED) and it is possible to achieve high precision, high reliability and low production cost because of the all electronic constructions, but the time reading method of this type has a defect in not being familiar due to the difference from traditional analog display with hand pointers.

SUMMARY OF THE INVENTION

This invention has been developed to eliminate the present defects of electronic watches and performs an analog time display suitable to the traditional sense by means of arranging radially a plurality of display segments and driving them one after another in specified direction, and also carries out time modification by operating the watch crown the same as that of a traditional mechanical watch and moreover achieves advanced or retarded time by selecting the turning direction of the crown and further performs digital display of date by providing a digital display unit with a drive coupled with the said analog display unit and enables modification of time and date by changing operational positions of the said crown. Therefore, this invention makes available an electronic watch which provides a readily perceived display of time and enables to modification of the time display forwardly or backwardly the same as in a traditional mechanical watch.

Hereafter, the electronic watch will be described in detail based on an embodiment shown in the accompanying drawings according to this invention.

BRIEF DESCRIPTION OF THE DRAWINGS

FIG. 1 shows a plan of one embodiment of electronic watch according to this invention has a watch case 1 and provides a display device 2 in which an analog display unit 3 comprising a radially arranged plurality of display segments therein and two digit display units 4 consisting of display segments arranged in alphanumerical shape at the center portion of a watch case 1 are comprised. The said analog display unit 3 has two display portions which are arranged as double concentric circles and each portion has 60 display segments. The 60 display segments of the inner circle are used for hour-unit display and the segments of both the inner and outer circles are used for minute-unit display. The outer display segments are named in the manner that one segment positioned at center top, that is, 12 o'clock position is symbol $m_0$ and the next ones in order in a clockwise direction are symbols $m_1, m_2 \ldots m_{59}$), and in the same manner the inner display segments are named in the manner that one segment at 12 o'clock position is symbol $h_0$ and next ones in order in a clockwise direction are ($h_1, h_2 \ldots h_{59}$). As described later in detail, the display segments ($m_0, m_1 \ldots m_{59}$) and corresponding display segments ($h_0, h_1 \ldots h_{59}$) are driven at one minute interval in order in a clockwise direction, that is they are conducted in a manner similar to the movement of the long hand of the hand pointer type watch and the segments ($h_0 \ldots h_{59}$) are driven at 12 minute time intervals independently of the segments ($m_0 \ldots m_{59}$) in order in a clockwise direction, so that they are connected in a manner similar to the movement of the short hand. Accordingly, reading the time is carried out out in the traditional sense of a mechanical watch.

Figure 1:
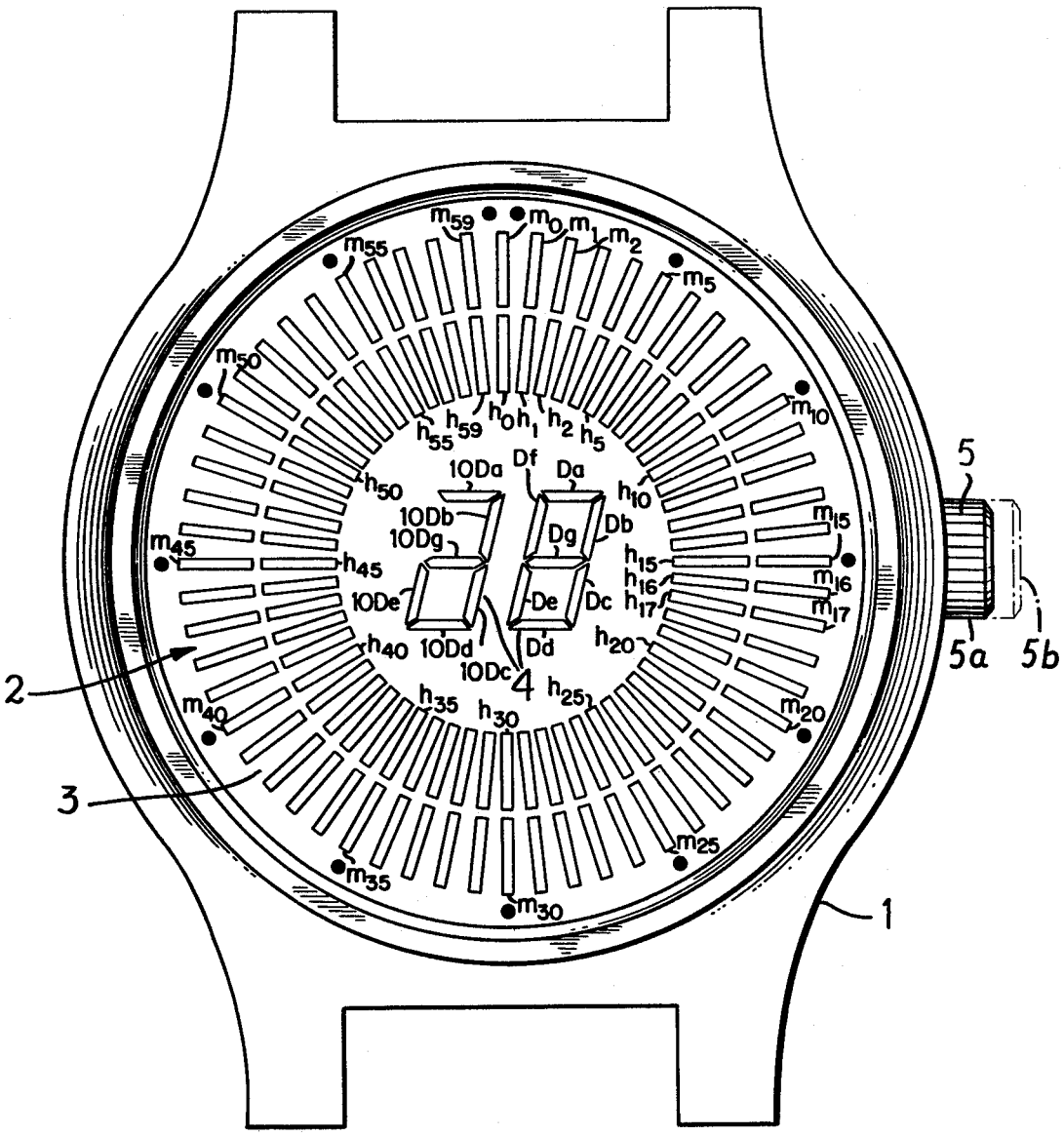
FIG. 1 shows a plan of one embodiment according to this invention.

The digital display portion (4) consisting of two parts is to display the date which is in the manner that the tenth decimal place of the date is displayed with a substantially alphanumerical arrangement of 6 display segments (10D*a*, 10D*b*, 10D*c*, 10D*d*, 10D*e*, 10D*g*) and the first decimal place of the date is displayed with an alphanumerical arrangement of 7 display segments (Da - Dg).

A crown 5 provided on the side face of watch case 1 operates when time modification is necessary, and time and date modifications may be carried out by operation of said crown 5 and modification switches are operated thereby so that time and date modification may be carried out. The said crown 5 has two operational positions that are shown as a first position shows (5a) with solid lines and a second position (5b) shown with two dotted chain lines and is slidable and bidirectionally rotatable.

The display device 2 comprising the analog display unit 3 and the digital display unit 4, is constructed as a display base plate made of glass or plastic such as a transparent, semitransparent or smoked plate and having plurality of recesses on the rear side thereof, and the display elements such as light emitting diodes are inserted in the said recess, and moreover the side walls of these recesses are caused to have irregular surfaces for maintaining high contrast of displays with diffused reflections. If the display elements are buried with mold material in the recesses, the refractive indexes of the base plate and mold material should be selected so as not to obstruct the function of diffused reflection with irregular surfaces. The display base plate serves also as a glass-cover of the traditional watch, therefore a thin flat watch can be produced by using this display base plate.

Figure 2:
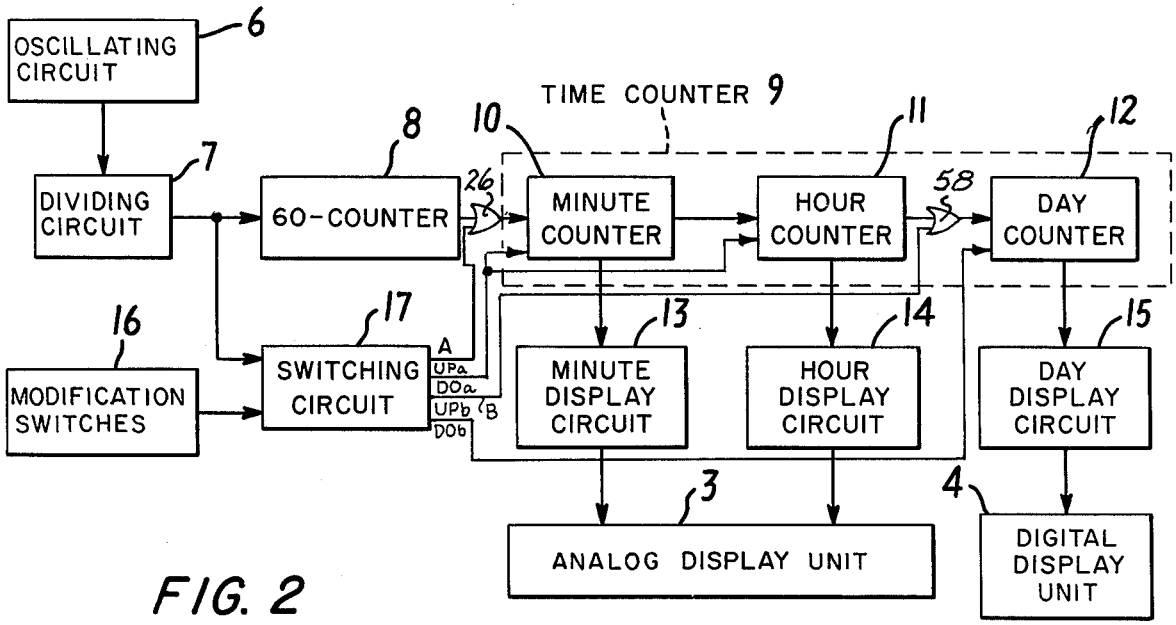
FIG. 2 shows a circuit diagram of one practical example of an electronic watch according to this invention.

FIG. 2 is a block diagram of an embodiment of the electronic watch shown in FIG. 1, and symbol 6 represents an oscillating circuit using an oscillator such as a quartz oscillator (not shown in the figure). Oscillating signal output from the said oscillating circuit 6 becomes a time measuring standard through a dividing circuit 7 consisted of plurality of dividing steps such as being divided to a one second pulse. The said 1Hz pulse (one second pulse) is input to a 60-counter 8 and turns into a one minute pulse (one pulse per one minute). This one minute pulse signal is supplied to a time counter 9 consisted of a minute counter 10, an hour counter 11 and a day counter 12 which correspond with every minute, hour and day unit respectively. The contents of the minute counter 10 and the hour counter 11 are supplied to a minute display circuit 13 and an hour display circuit 14 respectively and then are caused to display by the analog display unit 3. And the content of the day counter 12 is supplied to a day display circuit 15 and is also caused to display by the digital display unit 4.

A symbol 16 represents modification switches consisting of a group of mechanical switches which is operated by the crown 5 and controls a switching circuit 17 and then a high feed rate pulse for time modification is supplied to the time counter 9 corresponding with the turning operation of the crown 5 and replacing the normal supply of one minute pulses when time modification is required.

Figure 3:
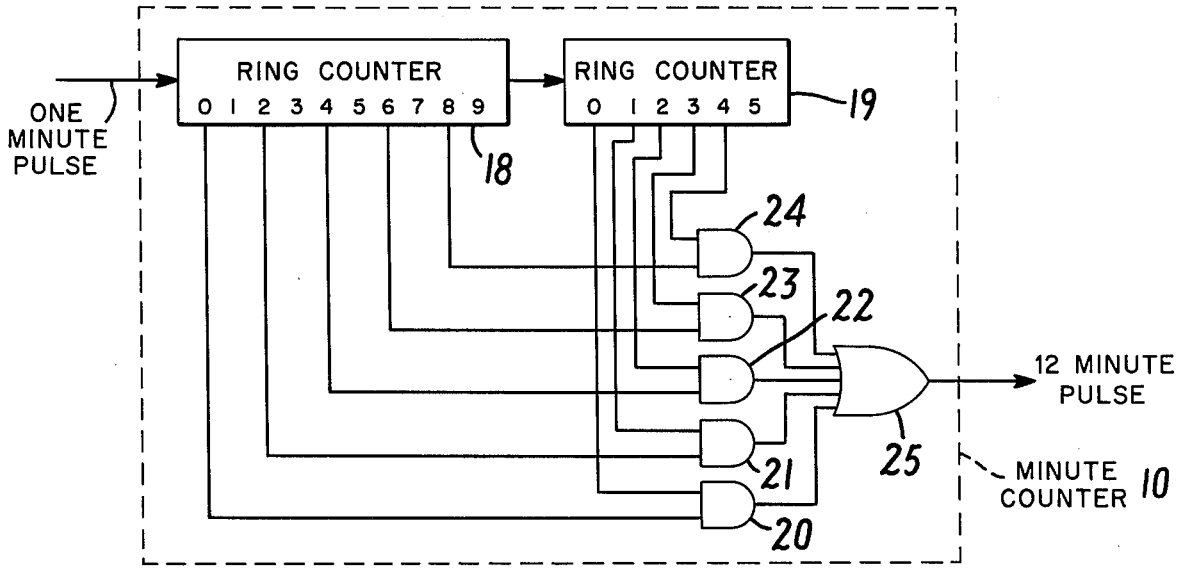
FIG. 3 shows a circuit diagram of one embodiment of minute counter.

The minute counter 10 as shown in the FIG. 3 comprises a 10-ring counter 18 and a 6-ring counter 19 both of which consist of shift registers operated at both up-mode and down-mode. The ring counter 18 shows the first decimal place of minute time unit and the ring counter 19 shows the tenth decimal place thereof.

Each output of the 0, 2, 4, 6, 8 terminals of the ring counter 18 of minute counter (10) is input to one of the input terminals of each AND circuit 20 - 24 having two input terminals respectively and each output of the 0, 1, 2, 3, 4 terminals of the ring counter 19 of minute counter (10) is input to the other input terminal of each AND circuit 20 - 24 respectively. All outputs of the AND circuits 20 - 24 are input to an OR circuit 25. The said OR circuit 25 outputs one pulse signal per 12 minutes and this 12 minute pulse is supplied to the hour counter (11).

Figure 4:
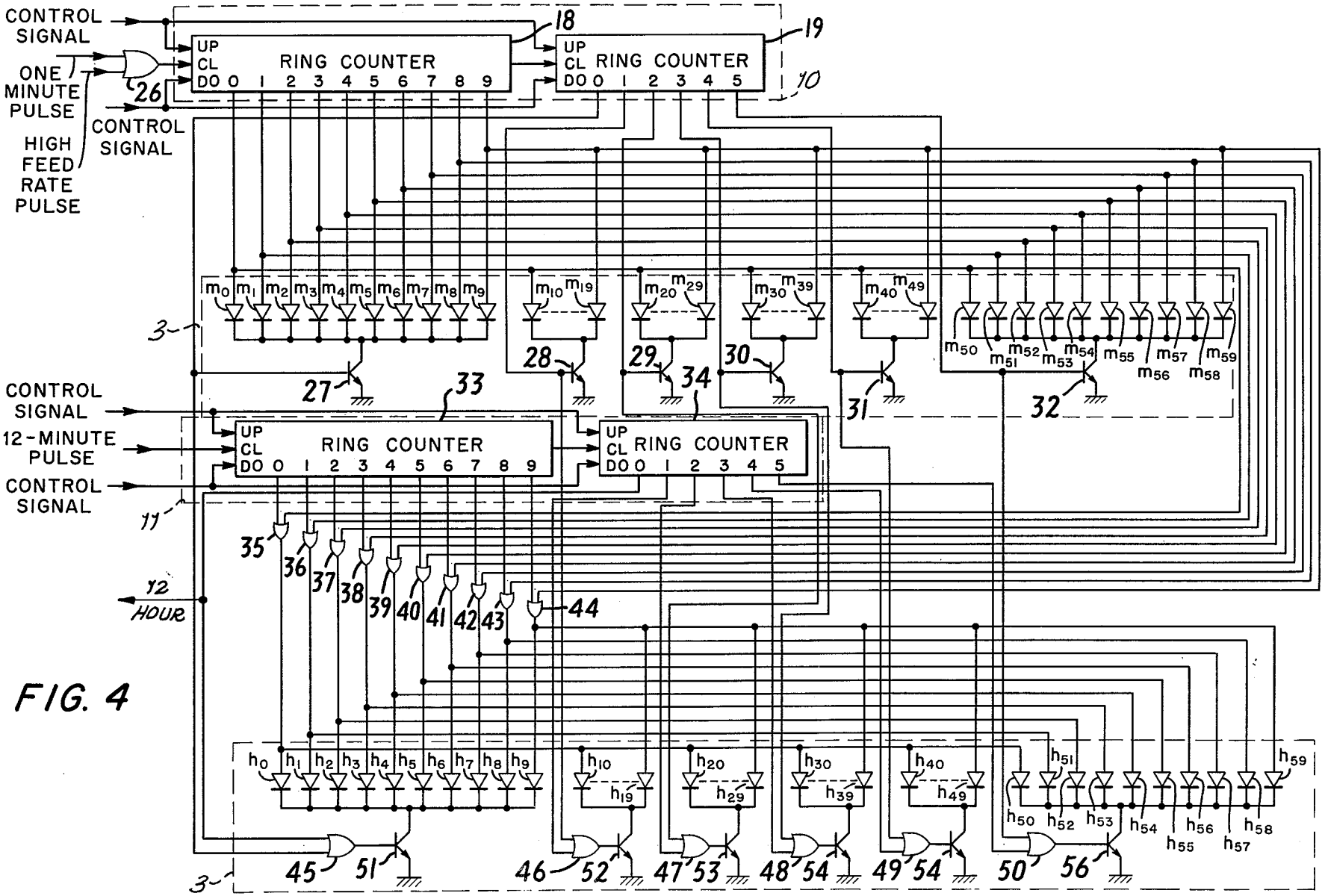
FIG. 4 shows a circuit diagram of one practical example to display time by an analog display unit as shown in FIGS. 1 and 2.

The ring counters 18 and 19 of minute counter 10 have input terminals CL and control terminals UP and DO as shown in FIG. 4, and an one minute pulse or high feed rate pulse output from the switching circuit 17 is input to the CL terminal of the ring counter (18) through an OR circuit 26, and the 10-minute pulse output from the ring counter 18 is input to the CL terminal of the ring counter 19. The control signal output from the switching circuit 17 is input in common to the control terminals UP of the ring counters 18 and 19, and also in the same manner the said control signal is input to the control terminals DO of the ring counters 18 and 19. As mentioned later with reference to FIG. 4, in normal condition the control signal output from the switching circuit 17 is always input to the control terminals UP, so that the ring counters 18 and 19 operate at up-mode, but the said counters 18 and 19 operate at down-mode only when modification of an advanced time is required in accordance with inputting the said control signal from the switching circuit 17 to the control terminals DO thereof.

FIG. 4 is a diagram of the total circuit system including the minute counter 10, the hour counter 11, the minute display circuit 13, the hour display circuit 14 and the analog display unit 3.

The outer display segments ($m_0 \ldots m_{59}$) comprising part of the analog display unit 3 are divided into six 6 blocks each including 10 successive segments as one unit such as "$m_0 - m_9$", "$m_{10} - m_{19}$", "$m_{20} - m_{29}$", "$m_{30} - m_{39}$", "$m_{40} - m_{49}$" and "$m_{50} - m_{59}$", and the anodes of the corresponding display segments (light emitting diodes) of each block such as that of segments $m_0$, $m_{10}$, $m_{20}$, $m_{30}$, $m_{40}$ and $m_{50}$ are charged by the output of the "0"-terminal of the ring counter 18, and in the same manner the anodes of the corresponding display segments in each block are respectively charged by the output of "1 - 9" terminals of the ring counter 18. The cathodes of the display segments in each block are connected in common to collectors of NPN transistors 27, 28, 29, 30, 31, 32 the emitters of which are grounded. Outputs of "0, 1, 2, 3, 4, 5" terminals of the ring counter 19 are respectively input to bases of the said transistors 27 - 32.

The hour counter 11 comprises a 10-ring counter 33 and a 6-ring counter 34 both of which are up and down counters, that is, the 12-minute pulse signal output from the OR circuit 25 shown in the FIG. 3, is input to the input terminal CL of the ring counter 33. And the 120-minute pulse signal output from the ring counter 33 is input to the input terminal CL of the ring counter 34. The control signal from the switching circuit 17 is selectively input to the control terminals UP and DO of the ring counters 33 and 34 and this control signal is always fed to the control terminals UP in normal condition, so that the ring counters 33 and 34 operate in the up-mode, but the said counters 33 and 34 operate in the down-mode only when modification of an advanced time is required in accordance with inputting the said control signal to the control terminals DO thereof.

Outputs of "0 - 9" terminals of the ring counter 33 are input together with outputs of "0 - 9" terminals of the ring counter 18 to corresponding OR circuits 35 - 44 respectively, the outputs of "0 - 5" terminals of the ring counter 34 are input together with outputs of "0 - 5" terminals of the ring counter 19 to corresponding OR circuits 45 - 50 respectively.

The display segments ($h_0 \ldots h_{59}$) comprising one part of the minute display unit and the hour display unit are divided into six (6) blocks including 10 consecutive segments as one unit such as "$h_0 - h_9$", "$h_{10} - h_{19}$", "$h_{20} - h_{29}$", "$h_{30} - h_{39}$", "$h_{40} - h_{49}$" and "$h_{50} - h_{59}$", and the corresponding display segments of each block such as the anodes of $h_0$, $h_{10}$, $h_{20}$, $h_{30}$, $h_{40}$, $h_{50}$ are charged with output of the OR circuit (35), and in the same manner the anodes of the corresponding display segments are respectively charged with the output of the OR circuits (36 - 44). The cathodes of the display segments in each block are connected in common to the collectors of NPN transistors 51, 52, 53, 54, 55, 56 the emitters of which are grounded. The output of the OR circuits 45 - 50 are respectively input to bases of the said transistors 51 - 56.

Next, the operational conditions of the circuits which are constituted as above mentioned will be described as follows:

The ring counter 18 in the minute counter 10 operates in the up-mode in the normal condition and the outputs of "0 – 9" terminals of said ring counter 18 become logic "1" of high potential successively one after another with every input of the one minute pulse signal and also the outputs of "0 – 5" terminals of the ring counter 19 become logic "1" of high potential by outputting pulse of the ring counter 18. Now, if the output of 5-terminal of the ring counter 18 and the output of 1-terminal of the ring counter 19 are both logic "1" level, the anodes of $m_5$, $m_{15}$, $m_{25}$, $m_{35}$, $m_{45}$, $m_{55}$, $h_5$, $h_{15}$, $h_{25}$, $h_{35}$, $h_{45}$, $h_{55}$ become high potential and also the bases of the transistors 28 and 52 become high potential, and accordingly the said transistors 28 and 52 become in the "ON" status, so that the cathode of display segments of the blocks including $m_{15}$ and $h_{15}$ becomes low potential. Therefore voltage is added between the anodes and cathodes of the segments $m_{15}$ and $h_{15}$ and then the said segments $m_{15}$ and $h_{15}$ operate to display. After this situation, when the next one minute pulse is input, the output of 6-terminal of the ring counter 18 becomes logic "1" level and accordingly the segments $m_{16}$ and $h_{16}$ operate to display at this time. In like sequence, the segments $m_0 - m_{59}$ and $h_0 - h_{59}$ operate to display successively one after another with each a input of a one minute pulse the same as the movement of the minute hand of a watch to display minute time units.

In normal condition, when the hour counter 33 operates in the up-mode, outputs of "0 – 9" terminals thereof become successively one after another logic "1" of high potential and the outputs of "0 – 5" terminals of the ring counter 34 become successively one after another logic "1" of high potential and outputs of "0 – 5" terminals of the ring counter 34 become successively one after another logic "1" of high potential by the pulse output from the ring counter 33 in each 120-minutes interval. Now, if the output of 2-terminal of the ring counter 33 is logic "1", and the output of 3-terminal of the ring counter 34 is also logic "1", the anodes of segments $h_2$, $h_{12}$, $h_{22}$, $h_{32}$, $h_{42}$, $h_{52}$ become high potential by the transistor 54 becoming "On" condition. Accordingly, voltage is charged only to the segment $h_{32}$ and drives the display thereof.

By the operations of the ring counters 33 and 34, the segments $h_0 - h_{59}$ operate to display successively one after another every 12-minutes and the display goes one round for each 12 hours similar to the movement of the hour hand of a watch to display hour time units.

As mentioned above, the displays of "minute" and "hour" by the analog display unit 3 are similar to the movement of the long and short hands of a pointer type watch so that the reaching of time display can be carried out in the traditional sense.

Figure 5:
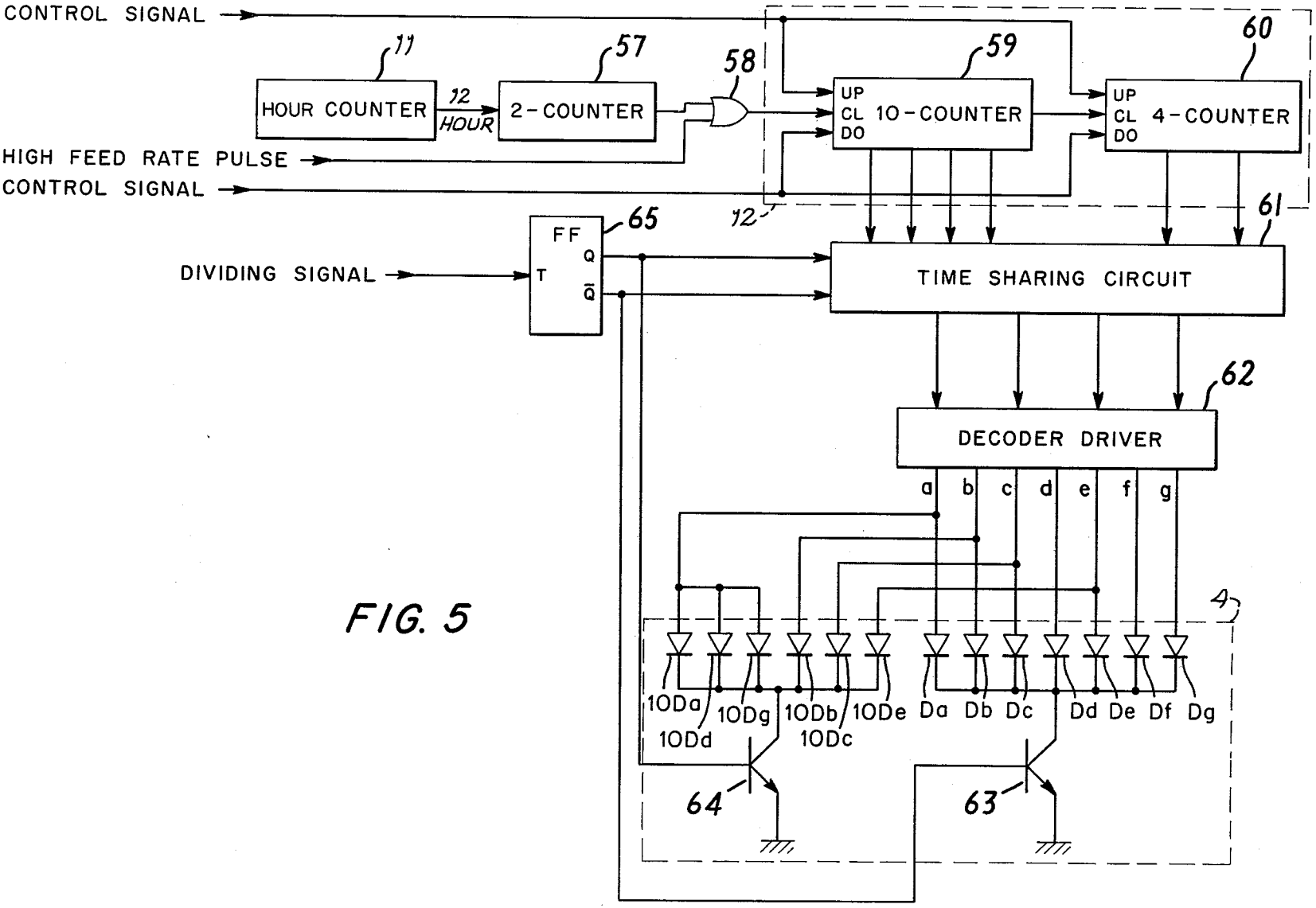
FIG. 5 shows a circuit diagram of one practical example to display date by a digital display unit as shown in FIGS. 1 and 2.

FIG. 5 shows one practical example of the circuit which displays date by the day counter 12, the day display circuit 15 and the digital display unit 4. One pulse signal at the rate of one each day, that is a day pulse, is output from the said binary counter 57 and is input to the input terminal CL of a 10-counter 59 through an OR circuit 58. A carry signal of the said 10-counter 59 is input to the input terminal CL of a 4-counter 60 consisting of an up and down counter.

The counting contents of said 10-counter 59 and said 4-counter 60, which comprise the day counter 12, are output with BCD-code and are fed selectively to a decoder driver 62 through time sharing circuit 61. The said decoder driver 62 converts input signals to segment signals of the 7 segments and the output signals thereof are fed to the display segments (Da - Dg, 10Da - 10De, 10Dg) which comprise the digital display unit 4. That is, in the segment signals output from the decoder driver 62, "*a*" segment signal is fed to anodes of Da, 10Da, 10Dd & 10Dg, "*b*" segment signal to anodes of Db, 10Db, "*c*" segment signal to anodes of Dc, 10Dc, "*d*" segment signal to anode Dd, "*e*" segment signal to anodes of De, 10De, "*f*" segment signal to anode of Df and "*g*" segment signal to anode of Dg.

The cathodes of Da - Dg are connected in common to the collector of transistor 63 which is emitter-grounded NPN type, and the cathodes of 10Da - 10De, 10Dg are also connected in common to the collector of transistor 64 which is emitter grounded NPN type.

Symbol 65 represents a flip-flop circuit FF, to which the dividing signal from the specified dividing step of the dividing circuit 7 (shown in the FIG. 2) is input to the input terminal T thereof, and the Q-output of the said FF 65 is fed to both the time sharing circuit 61 and the base of transistor 64 and also the Q-output thereof is fed to both the time sharing circuit 61 and the base of transistor 63. The time sharing circuit 61 passes outputs of the 10-counter 59 to the decoder driver 62 by responding to the Q-output of the FF 65 becoming logic "1" and passes outputs of the 4-counter 60 to the decoder driver 62 by responding to the Q-output of the FF 65 becoming logic "1". Therefore, when the transistor 63 turns "ON" when the Q-output of the FF 65 becomes logic "1", the counting contents of the 10-counter (59) are digitally displayed by the display segments Da - Dg and also when the transistor (64) turns "ON" when the Q-output of the FF 65 becomes logic "1", the counting contents of the 4-counter 60 are digitally displayed by the display segments 10Da – 10De, 10Dg.

The 10-counter 59 is an up and down counter of 4-bits and the 4-counter 60 is an up and down counter of 2-bits and also a well known feed back loop circuit to operate as a 16-counter is connected in between the two counters 59 and 60, but it is not shown in the figure.

A control signal issued from the switching circuit 17 is always input to the input terminals UP of the 10-counter 59 and the 4-counter 60 and both of said counters operate in up-mode in normal condition. When the modification of date is required, both of the said counters 59 and 60 operate in down-mode by inputting the control signal issued from the switching circuit 17 to the input terminals DO thereof. Further a high feed rate signal is input to the terminal CL of the 10-counter 59 through OR circuit 58 at the time of date modification and accordingly the counting contents of the 10-counter 59 and the 4-counter 60 are modified at high rate in up-mode or down-mode.

Figure 6:
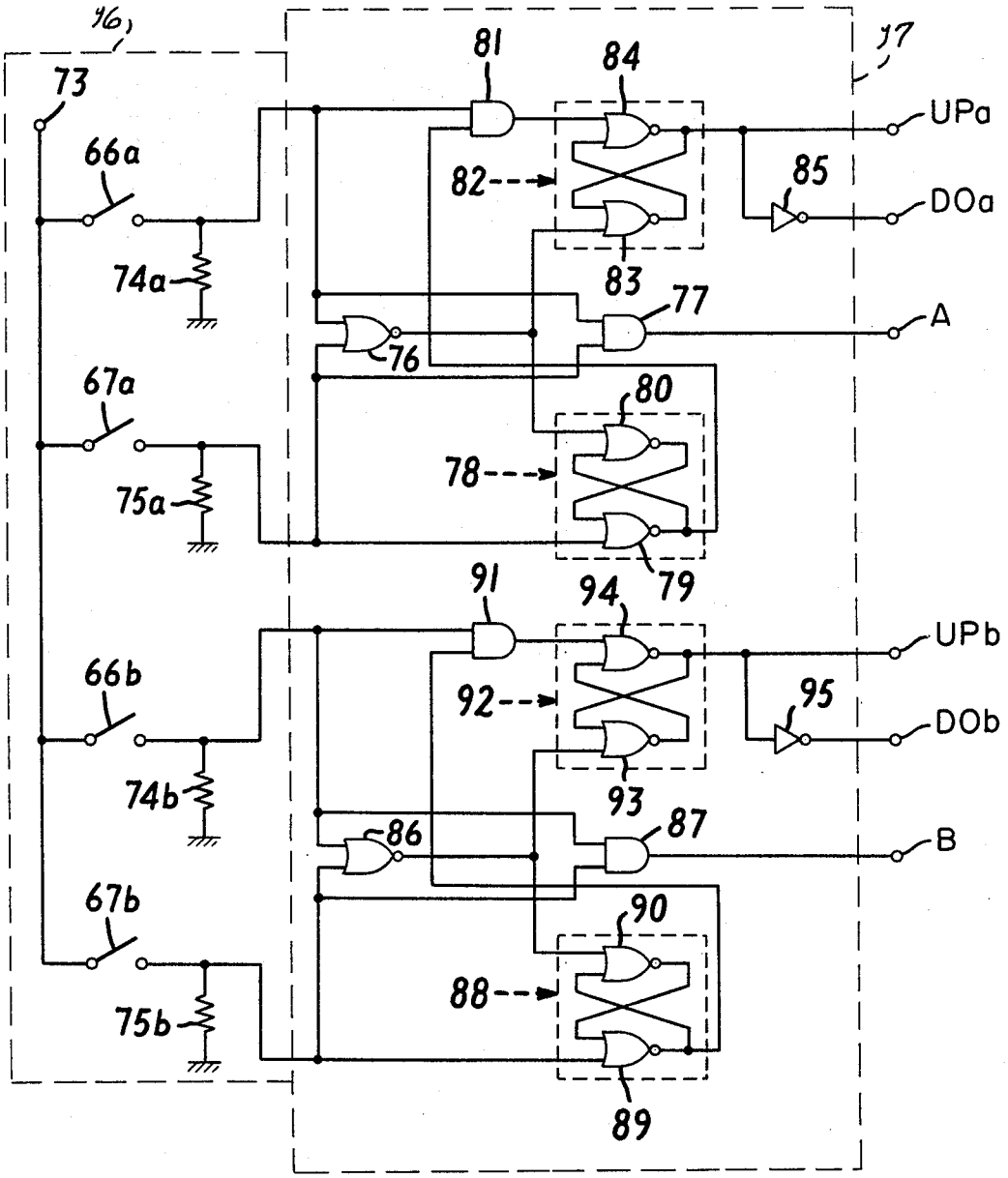
FIG. 6 shows a circuit diagram of one practical example of the modification switch and the switching circuit.
Figure 7:
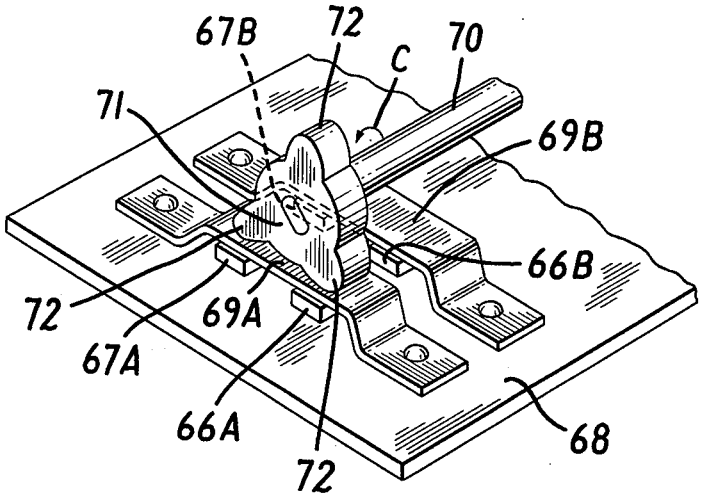
FIG. 7 shows a perspective niew of one practical example of the switch shown in FIG. 6.

FIG. 6 is a circuit diagram showing one of the practical examples of the modification switch 16 and the switching circuit 17. The modification switch 16 comprises switches 66*a* and 67*a* which are controlled in turn-on and turn-off operation thereof by a turning operation in the first operational position 5*a* of the crown 5 and switches 66*b* and 67*b* which are controlled in turn-on and turn-off operation thereof by a turning operation in the second operational position 5*b* of the crown 5. FIG. 7 is a drawing showing one of the practical examples of such modification switches, and Switch 66*a* comprises a fixed contact 66A mounted on a circuit base plate 68 and a movable contact 69A fixed at both ends thereof on the said base plate 68 and shaped in bent bridge-form so as to extend over the said fixed contact 66A and made of conductive material, and also the switch 67*a* comprises a fixed contact 67A mounted under of the said movable contact 69A and positioned side by side of the said fixed contact 66A and the movable contact 69A. On the other hand, the switches 66*b* and 67*b* are constituted similar to the switches 66*a* and 67*a*, and comprise fixed contacts 66B and 67B and a movable contact 69B. A rotating cam 71 having three projecting portions 72 at each angle of 60° circumferentially is fixed on a winding stem 70 of the crown 5, and when the crown 5 is positioned in the first operational position 5*a*, the rotating cam 71 is positioned against the movable contact 69A and similarly when the crown 5 is positioned in the second operational position 5*b*, the rotating cam 71 is positioned against the movable contact 69B. In the condition shown in FIG. 7, all switches 66*a*, 67*a*, 66*b*, 67*b*) are in Off status, but if the rotating cam 71 is made to turn in the direction of the arrow "C", that is, the crown 5 is made to turn in rightward direction in the first operational position 5*a*, the movable contact 69A is pushed by the projecting portion 72 of the rotating cam 71 and accordingly it contacts the fixed contact 66A and by further rotation of the said cam 71 the movable contact 69A breaks contact with the fixed contact 67A first and successively with the fixed contact 66A. That is, the switches 67*a* and 66*a* are each turned on once during 120° rotation of the cam (71). When the rotating cam 71 is made to turn in the direction of the arrow "C", the turnon of the switch 67*a* precedes that of the switch 66*a*, but when the rotating cam 71 is made to turn in reverse direction, the turn-on of the switch 66*a* precedes that of the switch 67*a*. Further, when the crown 5 is operated when transferred to the second operational position 5*b*, it will be be understood that the switches 66*b* and 67*b* turn-on respectively in order according to the turning direction of the crown 5.

Referring back to FIG. 6, the contacts of the switches (66*a*, 67*a*, 66*b*, 67*b*) are connected in common to a voltage supply terminal 73 having a potential equivalent to logic "1" and the other contacts thereof are connected to ground having a potential equivalent to logic "0" respectively through resistances (74*a*, 75*a*, 74*b*, 75*b*).

Outputs of the switches 66*a* and 67*a* are respectively input to a NOR circuit 76 and an AND circuit 77 both having two input terminals, and outputs of the switches 66*b* and 67*b* are respectively input to a NOR circuit 86 and an AND circuit 87 both having two input terminals. Outputs of the switch 67*a* is input to a flip-flop circuit 78 consisting of two NOR circuits 79 and 80 connected across each input terminal to other's output terminal and similarly the output of the switch 67*b* is input to a flip-flop circuit 88 consisting of two NOR circuits 89 and 90. Output of the flip-flop circuit 78, that is the output of the NOR circuit 79, is input to one of the input terminals of AND circuit 81 having two input terminals and the other one of the input terminals thereof receives the output of the switch 66*a*, and similarly output of the NOR circuit 89 of the flip-flop circuit 88 is input to one of the input terminals of AND circuit 91 having two input terminals and the other one of the input terminals thereof receives the output of the switch 66*b*. Output of the AND circuit 81 is input to a NOR circuit 84 of a flipflop circuit 82 consisting of two NOR circuits 83 and 84 and also output of the AND circuit 9o is input to a N0R circuit 94 of a flip-flop circuit 92 consisting of two NOR circuits 93 and 94. Output of the NOR circuit 76 is input to the NOR circuits 80 and 83 of the flip-flop circuits 78 and 82 respectively, and output of the NOR circuit 86 is input to the NOR circuits 90 and 93 of the flip-flop circuits 88 and 92 respectively.

The switching circuit 17 has an output terminal UPa to which the output of the N0R circuit 84 is fed, an output terminal DOa to which the output of the NOR circuit 84 is inverted by an inverter 85 and then is input thereto, an output terminal A to which the output of the AND circuit 77 is fed, an output terminal UPb to which the output of the NOR circuit 94 is fed, an output terminal DOb to which the output of the NOR circuit 94 is inverted by an inverter 95 and then is input thereto, and an output terminal B to which the output of the AND circuit 87 is fed.

The output terminal UPa is connected to the control terminals UP of the ring counters 18, 19, 33, 34 shown in FIGS. 3 and 4, and the output terminal DOa is connected to the control terminals DO of the ring counters 18, 19, 33, 34, and output of the output terminal A is input to the OR circuit 26 shown in FIGS. 3 and 4. One the other hand, the output terminal UPb is connected to the control terminals UP of the 10-counter 59 and the 4-counter 60 shown in FIG. 5, and the output terminal DOb is connected to the control terminals DO of the 10-counter 59 and the 4-counter 60, and also output of the output terminal B is input to the OR circuit 58 shown in FIG. 5.

Figure 8:
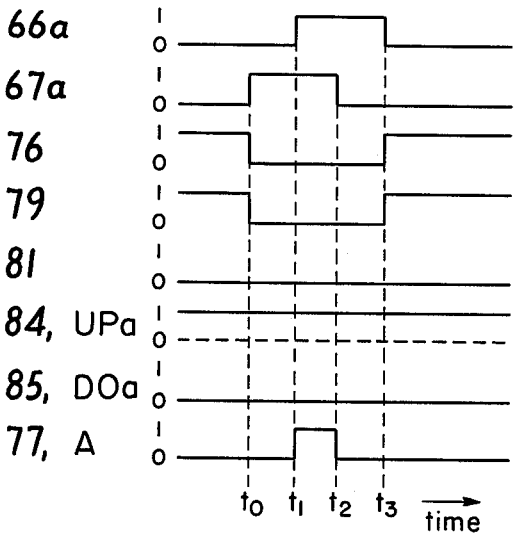
FIG. 8 is time-chart to describe the operation of the circuit shown in FIG. 6 in modification of retarded time.

Next, the operational condition of the circuit shown in FIG. 6 will be described referred to FIGS. 8 and 9.

In the normal condition, the switches 66*a*, 67*a*, 66*b*, 67*b*) are wholly turned-off and outputs of AND circuits 77 and 87 are logic "0" so that the output terminals A and B do not issue high feed rate pulses. In order that outputs of the OR circuits 76 and 86 are maintained in logic "1" and outputs of the AND circuits 81 and 91 are also maintained in logic "0", outputs of the NOR circuits 84 and 94 of the flip-flop circuits 82 and 92 respectively are always maintained in logic "1". Accordingly in normal condition, the control signal is output only from the output terminals UPa and UPb, and the minute counter 10, the hour counter 1 and the day counter 12 operate in the up-mode.

When the modification of retarded time is required, the crown 5 is placed at the first operational position 5*a* and is turned in rightward direction. As FIG. 8 shows wave-forms of every circuit in FIG. 6 with the same symbol marks put on each corresponding circuit, output of the NOR circuit 76, which was maintained in logic "1" when the switches 66*a*, 67*a* were turned off, first into logic "0" by turning on the switch 67*a* at "to" time. According to turning output of the switch (67*a* ) into logic "1" and output of the NOR gate 76 into logic "0", the flip-flop circuit 78 is set and output of the NOR gate 79 turns into logic "0" from logic "1". Though output of the switch (66*a* ) becomes logic "1" at "$t_1$" time according to the turning the output of the NOR gate 79 into logic "0", output of the AND circuit 77 is maintained in logic "0".

Accordingly the output logic of the flip-flop 78 does not change and output of the NOR circuit 79 is maintained in logic "1". When the switch 66*a* turns on at "$t_1$" time, output and the AND circuit 77 turns into logic "1" and maintains this condition until at "$t_2$" time that is turn-off time of the switch 67*a*. When the switch 66*a* turns off at "$t_3$" time after turn-off of the switch 67*a*, output of the NOR circuit 76 turns into logic "1" and at the same time the flip-flop circuit 78 is reset and also output of the NOR circuit 79 returns to logic "1".

As mentioned above, by rotating the crown 5 in rightward direction a high feed rate pulse, having a width corresponding to the time interval which both of the switches 67*a* and 66*a* are together turn-on condition ($t_1 - t_2$), is output from the output terminal A and the logic "1" control signal is also output from the output terminal UPa. Accordingly the ring counters 18, 19, 32, 34 operate in up-mode and the counting contents thereof can be changed by high feed rate pulses. One high feed rate pulse is issued in every 120° rightward turn of the crown 5, so that the modification of retarded time is conducted by proper turning operation of the crown 5.

When the modification of advanced time of the minute and hour display is required, the crown 5 is placed at the first operational position 5*a* and turned in reverse direction to the operation of retarded time modification.

Figure 9:
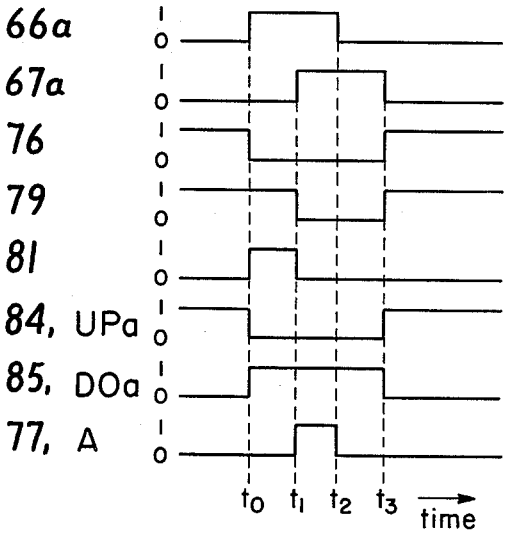
FIG. 9 is a time-chart to describe the operation of the circuit shown in FIG. 6 in the modification of advanced time.

As shown in FIG. 9, the switch 66*a* turns on by preceding switch 67*a* at "to" time and then output of the NOR circuit 76 turns into logic "0" from logic "1". And in order that output of the NOR circuit 79 of the flip-flop circuit 78 is logic "1", output of the AND circuit 81 turns into logic "1" by responding to turn-on of the switch 66*a* and the flip-flop circuit 82 is set and also output of the NOR circuit 84 turns into logic "0". In consequence, a control signal is output from the output terminal DOa. The switch 67*a* turns on at "$t_1$" time and accordingly the flip-flop circuit 78 is set and then output of the NOR circuit 79 turns into logic "0" and at the same time output of the AND circuit 81 also turns into logic "0". During the time interval between "$t_1$" and "$t_2$", which is the time of turn-off of the switch (66*a*), output of the AND circuit 77 becomes logic "1" and then a high feed rate pulse is output from the output terminal A. Just then the switch 67*a* turns off at "$t_3$" time, output of the NOR gate 76 turns into logic "1" and the flip-flop circuits 78 and 82 are reset and also outputs of the NOR circuits 79 and 84 turn into logic "1" and at the same time output of the control terminal DOa turns into logic "1" and further output of the control terminal UPa turns into logic "1", therefore all conditions return to normal.

As mentioned above, by leftward rotation of the crown 5, the switch 66*a* is turned on and at the same time a control signal is issued from the control terminal DOa and then the operations of the ring counter 18, 19, 32, 34 change to down-mode. Accordingly the counting contents thereof can be changed by the high feed rate pulse issued by turn-ons of the switches 66*a* and 67*a* together ($t_1 - t_2$). Therefore the time display changes at high rate for retarding direction by proper turning operation of the crown 5 and the modification of advanced time is conducted.

The crown 5 is pulled out in the second operational position 5*b* and is operated in the direction to turn-on the switch 67*b* preceding that of the switch 66*b*. Then, in this case as you will be understood from the circuit operations for time modification as described above, the control signal of logic "1" is output from the control terminal UPb and is supplied to the control terminal UP of the 10-counter 59 and the 4-counter 60 in the day counter 12, and at the same time the high feed rate pulse is output from the output terminal B and is input to the 10-counter 59 through the OR circuit 58. Accordingly, the day counter 12 operates in up-mode and the day-display changes at high rate in the advancing direction, so that the modification of retarded date is carried out. On the other hand, the crown 5 is operated in the direction to turn-on the switch 66*b* preceding to that of the switch 67*b* at the second operational position 5*b*. Then, the high feed rate pulse is issued from the output terminal B and at the same time the control signal is output from the control terminal DOb and is supplied to the control terminals DO of the 10-counter 59 and the 4-counter 60.

Accordingly the day counter 12 operates in down-mode and the day display changes at high rate in retarding direction, so that the modification of advanced date is carried out.

As mentioned above, the electronic watch according to this invention has been described in detail with reference to the embodiment shown in the drawings, however, the present invention is not limited to this embodiment and is capable of various modifications and improvements.

In order that the electronic watch of this invention performs time display by the analog display unit consisting of a plurality of the display segments arranged radially, time can be read in the same sense as that of a traditional hand-pointer type watch and also in order that the time-modification is to be performed by turning operation of the crown, it can be used the same as a conventional mechanical watch, and moreover in order that the time counters consist of up and down counters and control operational mode thereof by the turning direction of the crown, the modification of advanced or retarded time can be carried out in the traditional sense, and furthermore the digital display unit is equipped together with the analog display unit and displays the date thereby, and in order that the crown has first and second operational positions, the modifications of time and date can be selectively carried out, so that this watch can be used in the traditional sense and can attain a high precision, high reliability and low cost. Therefore it can attain the desired objects and provide an excellent watch for practical use.

I claim as follows:

1. An electronic timepiece comprising a case, an electronic analog time display unit for displaying hours and minutes, said analog time display unit comprising a base plate and a circular series of display segments arranged radially on a peripheral portion of said base plate, a digital date display unit in a center portion of said base plate for displaying the date, a minute counter providing output signals to said analog display unit to activate said display segments sequentially to indicate minutes, said minute counter comprising an up-down counter, an hour counter providing output signals to said analog display unit to activate selected ones of said display segments sequentially to indicate hours, said hour counter comprising an up-down counter, a day counter providing output signals to said digital display unit to indicate date, said day counter comprising an up-down counter, a crown on said case having two operational positions and rotatable in opposite directions, modification switch means controlled by said crown, said switch means comprising means for supplying high feed rate pulses selectively to said minute counter and to said day counter and means for selectively switching said counters to an up-counting mode and to a down counting mode so that said high feed rate pulses amend said time display and said date display selectively in a forward direction or in a backward direction.

2. An electronic timepiece according to claim 1, in which each said up-down counter comprises an up-down ring counter.

3. An electronic timepiece according to claim 1, in which said base plate is translucent and constitutes the front face of said timepiece, said base plate having on its inner face recesses in which said display segments of said analog display unit and said digital display unit are disposed.

4. An electronic timepiece according to claim 1, in which said crown when in one operational position is rotatable in one direction to amend time forwardly and is rotatable in the opposite direction to amend time backwardly and when in another operational position is rotatable in one direction to amend the date forwardly and is rotatable in the opposite direction to amend the date backwardly.

5. An electronic timepiece according to claim 4, in which said crown has a stem and in which said switch means comprises two switch units disposed side-by-side and cam means on said stem for operating said switch units, said stem being movable axially to bring said cam means selectively into one position for operating one of said switch units and into another position for operating the other of said switch units.

* * * * *